United States Patent [19]

Kaburagi et al.

[11] 4,444,397

[45] Apr. 24, 1984

[54] ADJUSTING DEVICE FOR A NET POLE

[75] Inventors: Hisashi Kaburagi, Urawa; Seiji Hayamizu; Chiaki Negishi, both of Koshigaya; Yoshiaki Ozawa, Tokyo, all of Japan

[73] Assignee: Senoh Kabushiki Kaisha, Tokyo, Japan

[21] Appl. No.: 382,299

[22] Filed: May 26, 1982

[30] Foreign Application Priority Data

Dec. 26, 1981 [JP] Japan ..... 56-195510[U]
Dec. 26, 1981 [JP] Japan ..... 56-195511[U]

[51] Int. Cl.[3] ..... A63B 61/04
[52] U.S. Cl. ..... 273/411; 273/29 BC
[58] Field of Search ..... 273/411, 29 B, 29 BB, 273/29 BC, 29 BD, 29 BE, 29 BF, 29 BG

[56] References Cited

U.S. PATENT DOCUMENTS 4,122,451 10/1978 Senoh ..... 273/29 BF

FOREIGN PATENT DOCUMENTS 48-40026 11/1973 Japan .
57-3339 1/1982 Japan .
57-3340 1/1982 Japan .
57-4995 1/1982 Japan .
20725 of 1913 United Kingdom ..... 273/29 BC
271140 5/1927 United Kingdom ..... 273/29 BD

*Primary Examiner*—William H. Grieb
*Attorney, Agent, or Firm*—Schwartz, Jeffery, Schwaab, Mack, Blumenthal & Koch

[57] ABSTRACT

An adjusting device for adjusting the height of a net pole and the tension of a net rope so as to set up a net used, for example, for a volley ball game, comprises an outer tube, an inner tube telescopically inserted in the outer tube, a stretching means for stretching or releasing a net rope, and a drive means for actuating the inner tube to rise or fall along the outer tube and the stretching means. The drive means is completely housed in the outer tube and actuated by a detachable handle through an opening formed in the outer tube. The rope stretching means is provided at the top end of the inner tube and actuated by the drive means so as to stretch or release the net rope. The drive means is a counter-rotation preventing mechanism per se.

16 Claims, 10 Drawing Figures

FIG. 3A
FIG. 3B
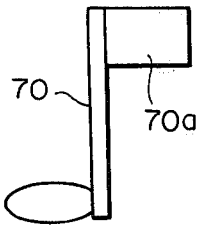
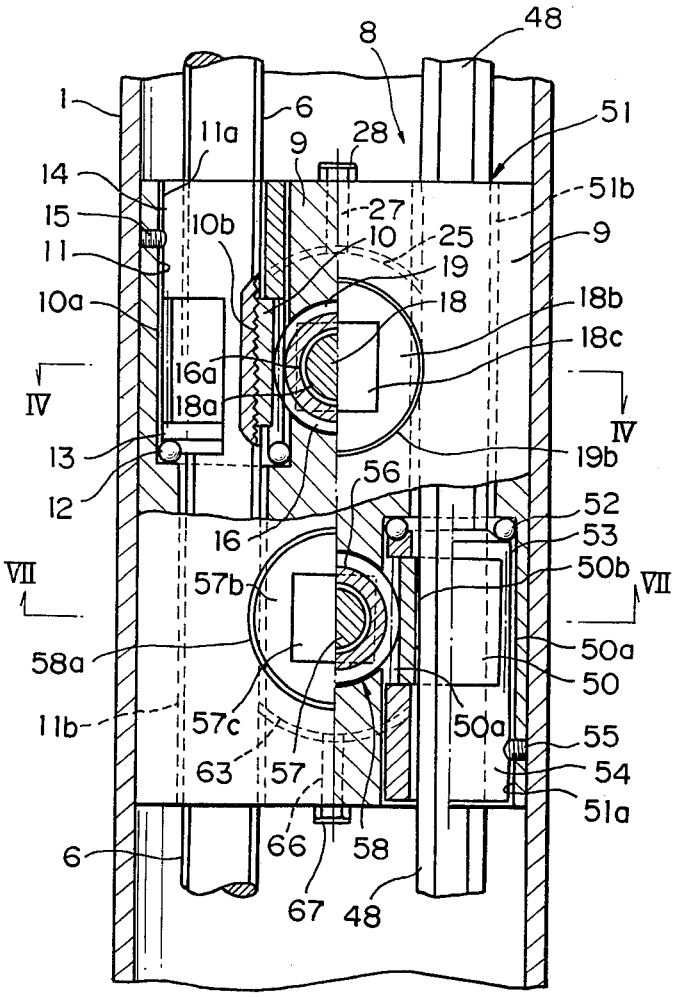

ADJUSTING DEVICE FOR A NET POLE

BACKGROUND OF THE INVENTION

The present invention relates generally to adjusting device for a net pole which is adapted to set up a net used for a game such as volley ball. More particularly, the invention relates to an adjusting device for adjusting a net pole to the height of the net and stretching or releasing a net rope for the net.

In general, a pair of net poles should be extended so as to set up a net for a volley ball game since the net pole is always stored in its shortened state. Further, the net pole should be exactly adjusted to the predetermined desired height of the net. The volley ball player has a tendency to play extremely close to the net so that he sometimes runs against the net pole. In conventional adjusting devices, however, a net rope stretching means and a drive mechanism such as gears, a crank arm or the like for driving the adjusting device are provided at the outer side of the net pole. The player may be wounded if he collides with such conventional devices.

Further, the conventional adjusting device is generally composed of a drive mechanism for adjusting the pole and the stretching means which is independent from a holding mechanism so that the complete adjusting operation can not be performed by a single action.

SUMMARY OF THE INVENTION

Therefore, it is an principle object of the present invention to provide an adjusting device for a net pole which has a good appearance and can be free from the danger that a player is injured by the drive unit of the adjusting device when the player collides with the pole member.

Another and more specific object of the present invention is to provide an adjusting device for a net pole which can be easily and certainly operated by a single action so as to adjust the pole to the height of net and stretch or release a net rope.

To accomplish the above mentioned and other objects, there is provided an adjusting device for a net pole, according to the present invention, which comprises an outer tube, an inner tube telescopically inserted in the outer tube, a stretching means for stretching or releasing a net rope and a drive means for driving the inner tube to rise or fall along the outer tube and the stretching means to stretch or release the net rope, which is completely housed in the outer and inner tubes and actuated by a rotation of a detachable handle.

BRIEF DESCRIPTION OF THE DRAWINGS

The present invention will be understood more fully from the detailed description give herebelow and from the accompanying drawings of the preferred embodiment of the present invention, which, however, should not be taken as limitative of the invention but for elucidation and explanation only.

In the drawings:

FIG. 3(A) is an enlarged vertical sectional view of the portion indicated by the arrow III in FIG. 1;

FIG. 3(B) is a schematic view of a handle to drive the adjusting device;

DESCRIPTION OF THE PREFERRED EMBODIMENTS

Referring now to the preferred embodiment of an adjusting device for a net pole according to the present invention, the structure is illustrated hereinbelow with reference to the accompanying figures.

Figure 1:
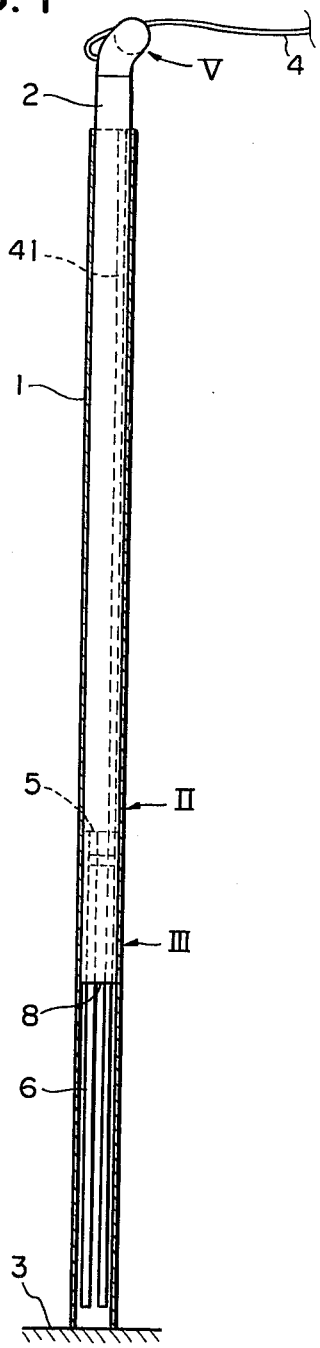
FIG. 1 is a schematic elevational view of a net pole for putting up a volley ball net, in which the preferred embodiment of an adjusting device is housed.

FIG. 1 shows schematically a whole structure of a net pole adapted to set up a net for a volley ball game in which the adjusting device according to the present invention is provided. The net pole generally comprises an outer tube 1 and an inner tube 2 which is telescopically inserted in the outer tube 1. The bottom of the outer tube 1 is fixed on a floor or ground 3 and the inner tube 2 is extended upwards so as to adjust the net pole to the height of a net rope 4.

Figure 2:
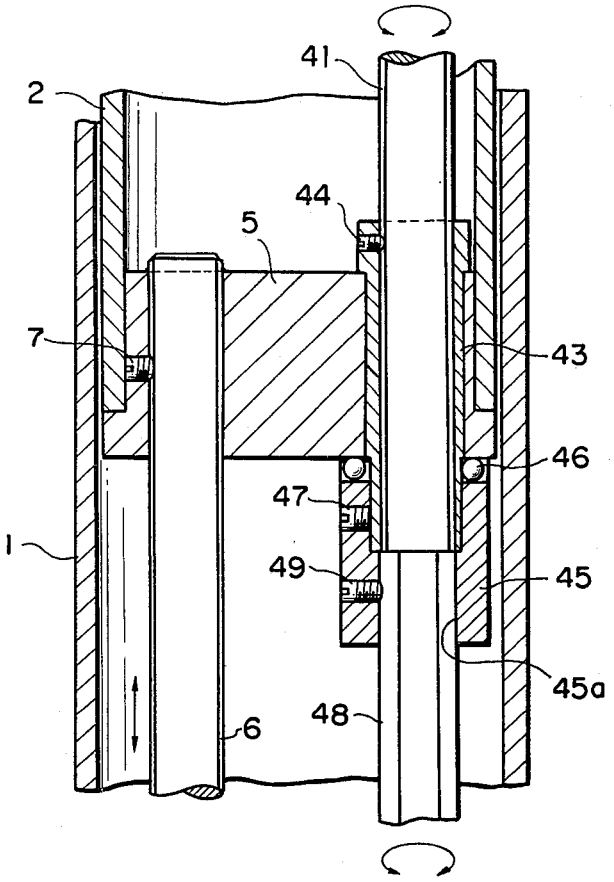
FIG. 2 is an enlarged vertical sectional view of the portion indicated by the arrow II in FIG. 1.

Referring to FIG. 2 and FIG. 3(A), there are shown enlarged sectional views of the essential portions of drive means of the adjusting device according to the present invention indicated by the arrows II and III in FIG. 1.

First the mechanism for adjusting the height of the net pole is described. In FIG. 2, there is shown a thrust block 5 which is secured to the bottom of the inner tube 2 through a bolt (not shown). A feed screw shaft 6, the whole length of which is threaded, is threadingly inserted in the thrust block 5 and fixed by a fixing screw 7. The length of the feed screw shaft 6 is sufficient to drive the inner tube 2 upwards or downwards and the shaft 6 is so arranged in the outer tube 1 that the axis of the shaft 6 is parallel to that of the outer tube 1. As shown in FIG. 3(A), a drive unit 8 includes a first section for a height adjusting mechanism and a second section for a rope stretching mechanism. The drive unit 8 is completely fixed in the outer tube 1 through at least one fixing bolt (not shown). The drive unit 8 comprises a block body 9 formed in a cylindrical shape having a diameter substantially equivalent to the inner diameter of the outer tube 1. That is, the first section of the block body 9 is formed with a through hole 11 which is arranged in parallel to the axis of the outer tube 1 so as to pass the feed screw shaft 6 therethrough. This through hole 11 comprises an upper hole 11*a* and a lower hole 11*b*, the former diameter being larger than the later. The upper hole 11*a* and the lower hole 11*b* define an annular step portion, on which a plurality of thrust balls 12 is provided, and further a thrust ring 13 is provided on the thrust balls 12. On the thrust ring 13 is provided a drive nut 10 the outer surface of which is formed with a crossed helical gear 10*a* with a right-hand helix angle of 45°, and the inner surface of which is formed with a female screw 10*b* adapted to engage with the feed screw shaft 6. Furthermore, a set pipe 14 is mounted on the drive nut 10 and fixed by a fixing screw 15 so as to allow only the drive nut 10 to rotate. The feed screw shaft 6 is threadingly engaged with the female screw 10*b* of the drive nut 10. According to this engagement, the feed screw shaft 6 can be moved upwards or downwards in accordance with the rotation of the drive nut 10 since the shaft 6 is prohibited from rotating.

Figure 4:
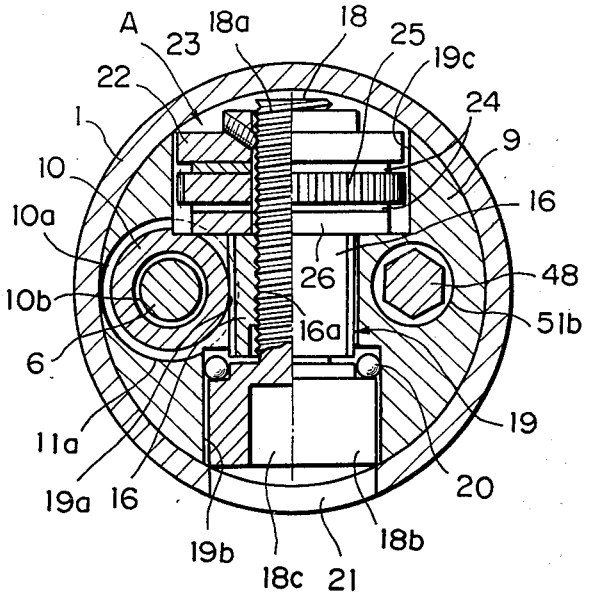
FIG. 4 is a cross sectional view taken along the line IV—IV in FIG. 3A showing a first section of a drive unit to adjust the height of a net pole.

Referring to FIG. 4, there is shown a cross sectional view taken along the line IV—IV in FIG. 3(A) in order to further explain the structure of the first section of the drive unit 8. The crossed helical gear 10*a* of the drive nut 10 is meshed with a drive gear 16 with a right-hand helix angle of 45°, the same as the gear 10*a*. The axis of the drive gear 16 is hollow and the inner surface of the hollow is formed with an internal screw 16*a*. A drive shaft 18 is rotatably inserted in the block body 9 so that the axis of the drive shaft 18 intersects at right angle with the axis of the outer tube 1. The drive shaft 18 is formed with an external screw 18*a* in the outer surface thereof. Thus, the internal screw 16*a* of the drive gear 16 is meshed with the external screw 18*a* of the drive shaft 18. The block body 9 is further formed with a through hole 19 which intersects at right angle to the axis of the outer tube 1. The through hole 19 is composed by three portions; a substantially center portion 19*a* defined such that the diameter is slightly larger than the outer diameter of the drive gear 16 and length is the substantially same as that of the drive gear 16, a front portion 19*b* (corresponding to the lower portion in FIG. 4) having the relatively large diameter relative to that of the center portion 19*a*, and a rear portion 19*c* (corresponding to the upper portion in FIG. 4) having the relatively large diameter relative to that of the front portion 19*b*. The diameter of the front portion 19*b* is slightly larger than a head 18*b* of the drive shaft 18 so that the head 18*b* is housed in the front portion 19*b* through a plurality of thrust balls 20 which is arranged between the shoulder of the head and the step defined by the front portion 19*b* and the center portion 19*a* of the through hole 19. Further, the head 18*b* is formed with a square key hole 18*c*. In front of the square key hole 18*c*, an opening 21 is formed in the outer tube 1 so as to allow a handle key 70*a* of an adjusting handle 70 as shown in FIG. 3(B) to engage with the key hole 18*c* through the opening 21.

On the other hand, the rear end of the drive shaft 18 is provided with a friction clutch "A". That is, the friction clutch "A" comprises an annular disc plate 22 which is secured to the shaft 18 through a fixing screw 23, a ratchet 25 which is rotatably and slidably assembled on the drive shaft 18, two pieces of liner 24 which sandwich the ratchet 25 therebetween, and a pressing annular plate 26 which is rotatably and slidably assembled on the drive shaft 18 and pressingly contacted to the step defined between the rear portion 19*c* and the center portion 19*a*. The ratchet 25 is meshed with a click 27 which is inserted into the block body 9 and always urged towards the ratchet 25 by means of a pressure plate spring 28 as shown in FIG. 3(A).

In the structure described above, when the key 70*a* of the handle 70 is inserted into the key hole 18*c* and the handle 70 is rotated clockwise, the driving mechanism of the first section of drive unit is as follows. According to the clockwise rotation of the drive shaft 18, the drive gear 16 is moved upwards in FIG. 4 since the drive gear 16 can not be rotated on account of the large rotation resistance due to the threadingly engagement between the crossed helical gear 10*a* of the drive nut 10 and the drive gear 16 so that the rotating force transmitted from the external screw 18*a* to the internal screw 16*a* is converted into the force to move the gear 16 vertically. Then, the drive gear 16 pushes the pressing annular plate 26 of the friction clutch "A" upwards in FIG. 4. When the pushing force of the gear 16 exceeds a predetermined value, the friction clutch "A" connects between the drive shaft 18 and the drive gear 16 so that they are rotated together. Accordingly, the drive nut 10 is also rotated clockwise so that the feed screw shaft 6, which can not be rotated, is moved upwards in FIG. 3. As a result, the inner tube 2 is also moved upwards through the thrust block 5 secured to the feed screw shaft 6.

When rotation of the handle 70 is stopped, the click 27 meshes with the ratchet 25 so that the ratchet 25 is prevented from counter-rotating. Therefore, the drive gear 16, which is tightly contacted with the ratchet 25, also doesn't rotate, so that the inner tube 2 is maintained at the new position without any position fixing mechanism.

On the contrary, when the handle 70 is rotated counter-clockwise, the drive gear 16 is separated from the friction clutch "A" and moved downwards in FIG. 4 by the screw movement between the internal screw 16*a* and the external screw 18*a* so that the drive gear 16 is forced to tightly contact the end surface of the head 18*b* of the drive shaft 18. Thus, the drive gear 16 and the drive shaft 18 are rotated together in the same direction. As a result, the drive nut 10 is rotated counter-clockwise so that the feed screw shaft 6 is moved downwards in FIG. 3(A), thereby lowering the inner tube 2. In such manner, the drive means according to the present invention can adjust the height of net pole, fix the height, and hold the position or release the position by only the operation of the handle 70.

Figure 5A:
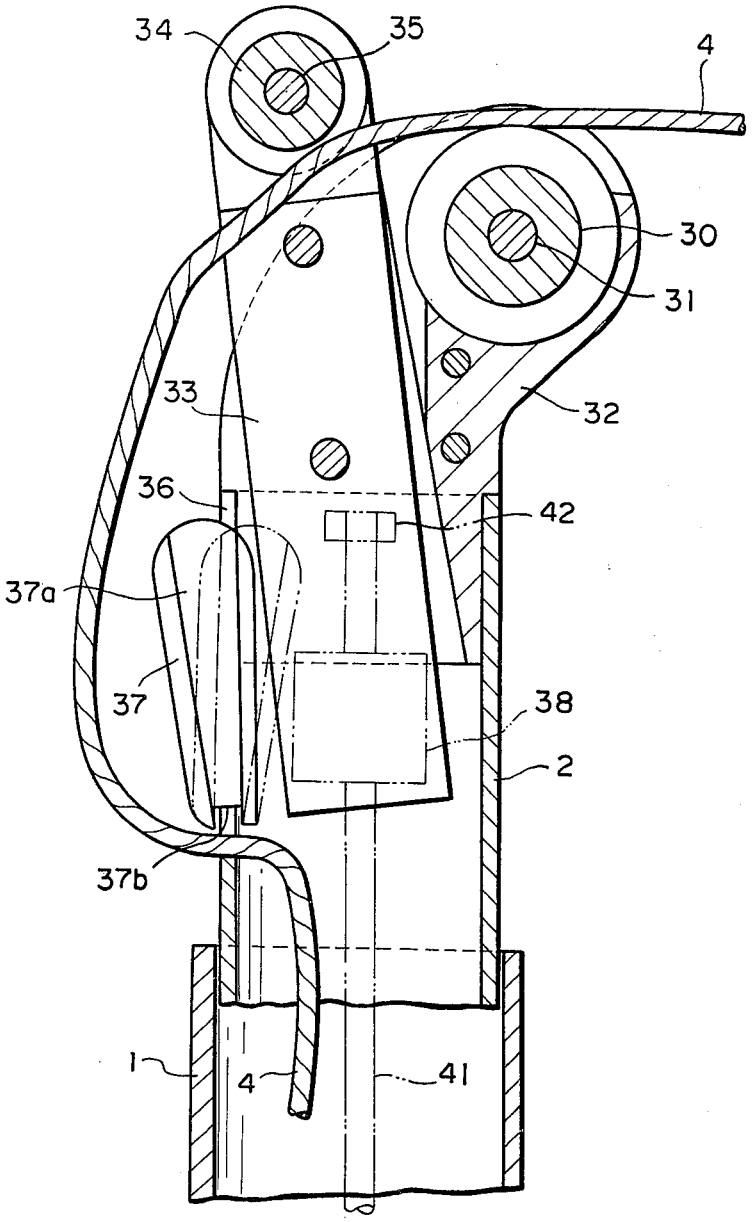
FIG. 5(A) is an enlarged sectional view of the head portion of the net pole indicated by the arrow V in FIG. 1 showing a rope stretching means in a rope released position.
Figure 5B:
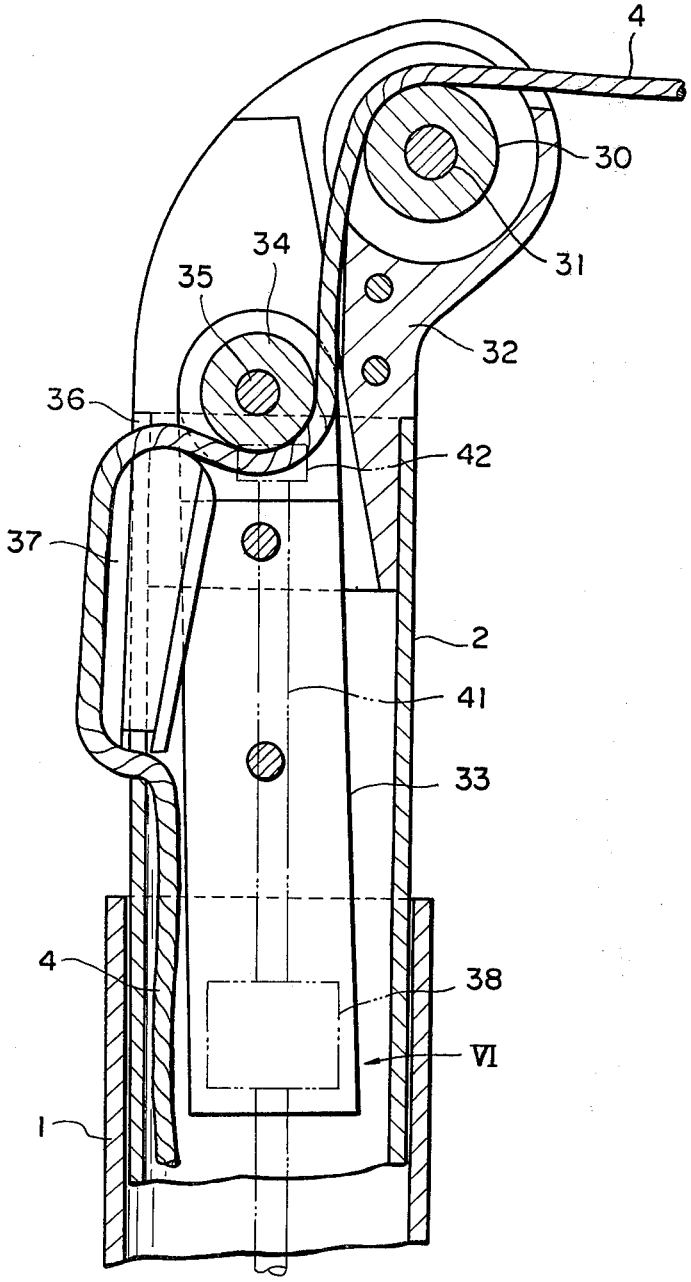
FIG. 5(B) is an enlarged sectional view of the head portion of the net pole indicated by the arrow V in FIG. 1 showing a rope stretching means in a rope stretched position.

Next, the mechanism of the rope stretching means is described. Referring to FIGS. 5(A) and 5(B), there are respectively shown the released and stretched states of an embodiment of net rope stretching means which is provided in the top end of the inner tube 2. In the figures, the reference numeral 30 denotes a fixed guide pulley which is rotatably mounted on a pivot 31. The pivot 31 is secured to a metal bracket 32 fixed to the top end of the inner tube 2. On the other hand, the reference numeral 33 denotes a movable bracket and the reference numeral 34 denotes a movable guide pulley which is rotatably secured to the top end of the movable bracket 33 through a pivot 35.

Further, the reference numeral 36 denotes a longitudinal slot having a predetermined length, which is formed opposite to the fixed guide pulley 30 in the top end of the inner tube 2. The reference numeral 37 denotes a rope stopper and the top end of which is formed in an arc shape, and both side surfaces of which are formed with substantially fan shaped recess 37*a*, which is widened upwardly. The fan shaped recess 37*a* is engaged with the side edge of the longitudinal slot 36 so that the stopper 37 can freely swing rightwards or leftwards in the figure and slidably moved along the longitudinal slot 36. The rope stopper 37 is further formed with a bottom groove 37*b* which rides on the lower edge of the longitudinal slot 36. The net rope 4 is fed into the inner tube 2 by passing through over the fixed guide pulley 30, under the movable guide pulley 34, and the narrow space defined between the bottom groove 37*b* and the lower edge of the slot 36. Then the rope 4 hangs a sufficient length into the interior of the inner tube 2 to prevent the rope 4 from slipping out of the tube 2.

Figure 6A:
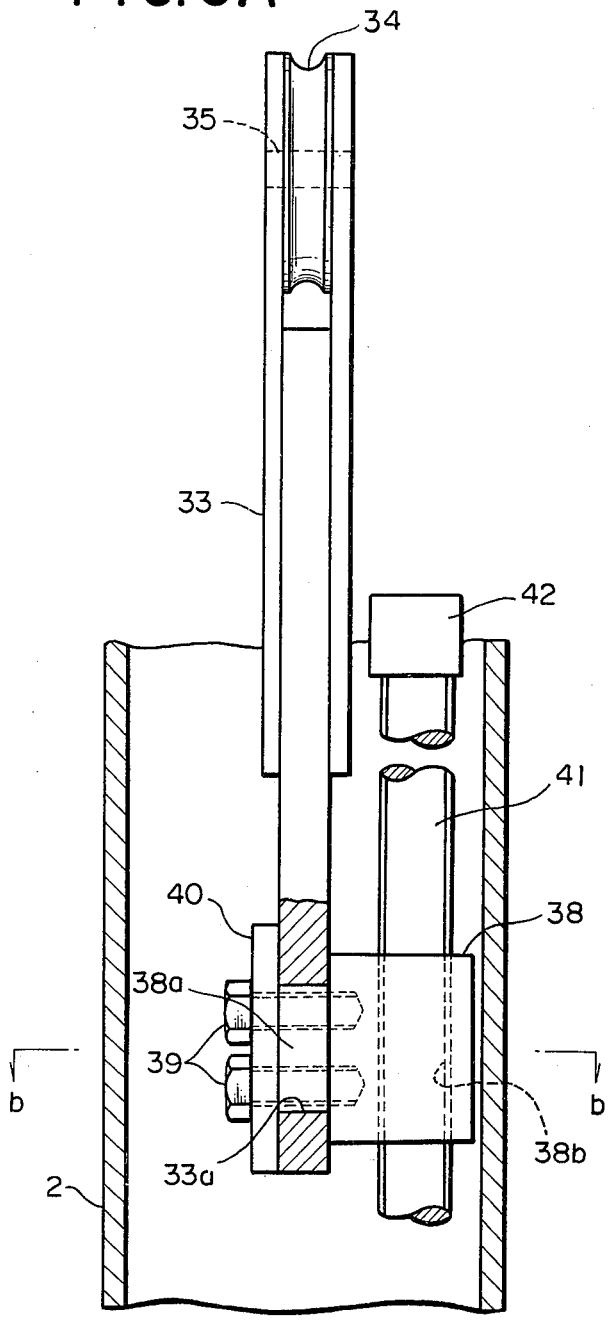
FIG. 6(A) is an enlarged sectional view of the portion indicated by the arrow VI in FIG. 5(B)
Figure 6B:
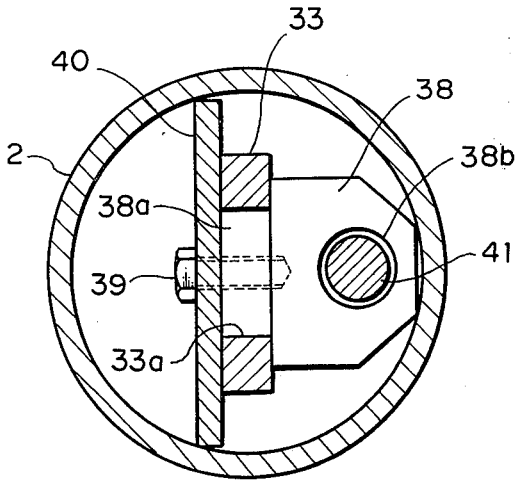
FIG. 6(B) is a cross sectional view taken along the line b—b in FIG. 6(A)

The movable bracket 33 is moved upwards or downwards through a drive linkage shown in FIGS. 6(A) and 6(B). That is, the lower end of the bracket 33 is formed with a through hole 33*a* in which a cylindrical neck 38*a* of a nut 38 is inserted. The bracket 33 is loosely secured to the cylindrical neck 38*a* through two bolts 39 and a washer plate 40 so as to allow the bracket 33 to rotate about the neck 38*a*. The nut 38 is formed with a vertical through hole 38*b* which is arranged parallel to the axis of the inner tube 2 and the inner surface of which is formed with screw threads. As shown in FIG. 1, there is a second feed screw shaft 41 in the net pole, which is arranged parallel to the axis of the pole. The second feed screw shaft 41 is threadingly passed through the through hole 38*b* and provided with a stopper block 42 at the top end thereof so as to prevent the shaft 41 from disengaging with the through hole 38*b*.

The bottom of the second feed screw shaft 41 is supported by the thrust block 5 as shown in FIG. 2 so that the shaft 41 is prevented from vertical moving but allowed to rotate only about its axis. That is, the shaft 41 is threadingly inserted in a stepped coupling tube 43 and fixed by a fixing screw 44. The coupling tube 43 is rotatably inserted in a through hole formed in the thrust block 5. The protruded portion of the tube 43 is engagingly covered with a joint tube 45 through a plurality of thrust ball bearing 46 and fixed by a fixing screw 47. The joint tube 45 is formed with a hexagonal cross section hole 45*a* arranged coaxially with the shaft 41. Into the hexagonal hole 45*a*, a hexagonal cross section shaft 48 is inserted and fixed by a fixing screw 49 so as to rotate the two shafts 41 and 48 together as if a single shaft. This shaft 48 is not limited only to a hexagonal cross section, but any polygonal cross section shaft which can transmit torque to the shaft 41 can also be used.

As shown in FIG. 3(A), the shaft 48 is passed through a hollow gear 50 provided in the second section of the drive unit 8 set in the outer tube 1 so as to allow the shaft 48 to move upwards or downwards. As explained above, the drive unit 8 comprises a first drive mechanism for driving the feed screw shaft 6 to adjust the height of pole and a second drive mechanism for driving the feed screw shaft 41 to control the net rope 4. That is, a vertical through hole 51 is formed parallel to the axis of the outer tube 1 in the block body 9. The substantially lower half hole 51*a* of the through hole 51 is so designed that its diameter is larger than that of the upper half hole 51*b*. The hollow gear 50 is set in the lower half hole 51*a* through a plurality of thrust balls 52 and an annular thrust ring 53 which are arranged at the shoulder defined by the lower and upper half holes before inserting the gear 50. The hollow gear 50 includes a crossed helical gear 50*a* with a right hand helix angle of 45° formed in the outer annular surface of the gear 50 and a hexagonal hole 50*b* through which the hexagonal shaft 48 is loosely passed. Further, a supporting tube 54 is provided under the gear 50 so as to support the gear 50 and secured to the block body 9 by means of a fixing screw 55. Thus, the hollow gear 50 is prohibited from vertically moving, but can be rotated. Accordingly, the hexagonal shaft 48 is rotated in response to the rotation of the hollow gear 50, thereby simultaneously rotating the feed shaft 41 in the same direction.

Figure 7:
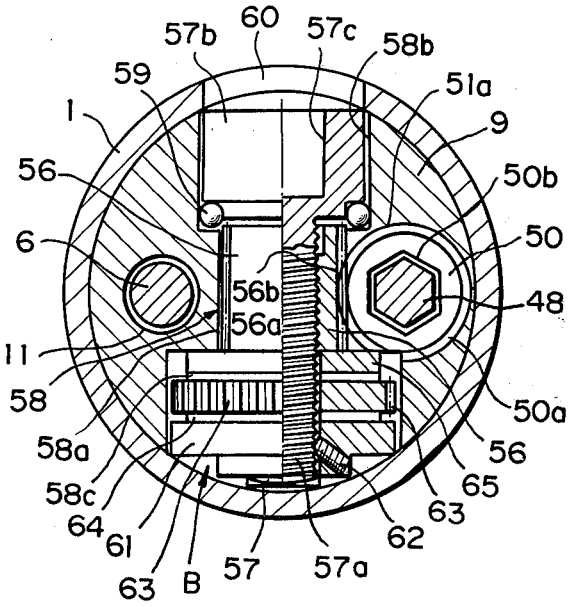
FIG. 7 is a cross sectional view taken along the line VII—VII in FIG. 3A showing a second section of a drive unit to adjust a rope stretching means.

A drive mechanism for driving this hollow gear 50 is shown in FIG. 7, in which there is a cross sectional view taken along the line VII—VII in FIG. 3(A). In the figure, the reference numeral 56 denotes a drive gear which includes an internal screw 56*a* and an external screw 56*b*. This external screw 56*b* is so threaded with a right hand helix angle of 45° in the same manner as the crossed helical gear 50*a* as to mesh therewith. The drive gear 56 is so arranged that the axis of the gear 56 intersects at right angles with that of the outer tube 1. Further, the drive gear 56 is threadingly supported by a drive shaft 57 arranged coaxially with the drive gear 56 in the block body 9. That is, the internal screw 56*a* meshes with the external screw 57*a* of the drive shaft 57. The block body 9 is formed with a through hole 58 in which the drive gear 56 and the drive shaft 57 are provided. The through hole 58 includes three portions; a substantially center portion 58*a* defined that the diameter is slightly larger than the outer diameter of the drive gear 56 and the length is substantially the same as that of the drive gear 56, a front portion 58*b* (corresponding to the upper portion in FIG. 7) having the relatively large diameter relative to that of the center portion 58*a*, and a rear portion 58*c* (corresponding to the lower portion in FIG. 7) having the relatively large diameter relative to that of the front portion 58*b*. The diameter of the front portion 58*b* is slightly larger than a head 57*b* of the drive shaft 57 so that the head 57*b* is housed in the front portion 58*b* through a plurality of thrust balls 59 which is arranged between the shoulder of the head 57*b* and the step defined by the front portion 58*b* and center portion 58*a* of the through hole 58. Further, the head 57*b* is formed with a square key hole 57*c*. In front of the square key hole 57*c*, an opening 60 is formed in the outer tube 1 so as to allow the handle key 70*a* of the adjusting handle 70 as shown in FIG. 3(B) to engage with the key hole 57*c* through the opening 60.

On the other hand, the rear end of the drive shaft 57 is provided with a friction clutch "B". That is, the friction clutch "B" comprises an annular disc plate 61 which is secured to the shaft 57 through a fixing screw 62, a ratchet 63 which is rotatably and slidably assembled on the drive shaft 57, two pieces of liner 64 which sandwich the ratchet 63 therebetween, and a pressing annular plate 65 which is rotatably and slidably assembled on the drive shaft 57 and pressingly contacted to the step defined between the rear portion 58*c* and the center portion 58*a*. The ratchet 63 is meshed with a click 66 which is inserted into the block body 9 and always urged towards the ratchet 63 by means of a pressure plate spring 67 as shown in FIG. 3(A).

In the structure described above, when the key 70*a* of the handle 70 is inserted into the key hole 57*c* and the handle 70 is rotated clockwise, the driving mechanism of this structure is as follows. According to the clockwise rotation of the drive shaft 57, the drive gear 56 is moved downwards in FIG. 7 owing to the threadingly engagement between the external screw 57*a* of the shaft 57 and the internal screw 56*a* of the drive gear 56 so that the drive gear 56 pushes the pressing annular plate 65 of the friction clutch "B". When the pushing force of the gear 56 exceeds a predetermined value, the friction clutch B connects between the drive shaft 57 and the drive gear 56 so that they are rotated together. Accordingly, the hollow gear 50 is also rotated clockwise so that the hexagonal shaft 48; that is, the feed screw shaft 41 is rotated in the same direction. As the feed screw shaft 41 rotates, the nut 38 is moved downwards since the nut 38 can not be rotated. Consequently, the movable bracket 33 provided with the movable guide pulley 34 is moved downwards so that the movable guide pulley 34 enters into the inner tube 2 for a predetermined depth as shown in FIG. 5(B). According to this movement, the net rope 4 is forcedly pulled down into the inner tube 2 by the pulley 34 so that the head of the stopper 37 is also forced down by the movement of the net rope 4. As a result, the net rope 4 is fixed between the bottom of the rope stopper 37 and the lower end of the longitudinal slot 36. As the movable guide pulley 34 is further moved downwards, the free end of the net rope 4 which is connected to a net is also further pulled so that the net rope 4 is completely stretched.

Even if the rotation of the handle 70 is discontinued or the handle 70 is detached from the key hole 57*c* before completely stretching, the click 66 will engage with the ratchet 63 so as to prevent the ratchet 63 from counter-rotating. Therefore, the drive gear 56 is also prevented from counter-rotating since the drive gear 56 is tightly connected to the ratchet 63 through the friction clutch "B". Consequently, it is possible to maintain the movable bracket 33 and the movable guide pulley 34 in its suspended position without any suspending means.

On the other hand, when the handle 70 is rotated counter-clockwise, the drive gear 56 is separated from the friction clutch "B" and moved upwards in FIG. 7 due to the screwing movement between the external screw 57*a* of the drive shaft 57 and the internal screw 56*a* of the drive gear 56. The drive gear 56 is forcedly contacted to the head 57*b* of the drive shaft 57 and then they are rotated together. Accordingly, the hollow gear 50 is rotated counter-clockwise so that the movable bracket 33 is subjected to move upwards as shown in FIG. 5(A) since the rotation movement of the feed screw shaft 41 transmitted through the hexagonal shaft 48 is converted into the vertical movement of the fixed nut 38. As a result, the movable pulley 34 releases the net rope 4. In this manner, the adjusting device according to the present invention can stretch the net rope 4 and hold its stretched position, or release the net rope 4 from the stretched position by operating only the handle 70.

As given explanation above, the adjusting device for a net pole according to the present invention can easily adjust the height of the pole and the tension of the net rope by operating only the rotation of the handle. Especially, since the drive unit of the adjusting device is completely housed in the outer tube of the net pole and the adjusting handle is detachably engaged with the drive unit, the net pole according to the present invention can be improved with respect to its external appearance and free from the danger that a player is wounded by the drive unit or the adjusting handle when the player collides with the net pole. Further, since the drive unit contains clutch mechanisms so as to hold the actuated position and prevent the drive unit from counter rotation, the invented adjusting device does not need additional holding and releasing means.

It will be understood by those skilled in the art that the foregoing description is in terms of a preferred embodiment of the present invention wherein various changes and modifications may be made without departing from the spirit and scope of the invention, which is to be defined by the appended claims.

What is claimed is:

1. An adjusting device for a net pole comprising:

an outer tube;

an inner tube telescopically inserted in said outer tube;

a rope holding means for holding or releasing a net rope, said means disposed at the top end of said inner tube, said rope holding means being adapted to stretch the end of the net rope without winding by leading the net rope into the inner tube; and a drive means for driving said inner tube to move upwards or downwards along said outer tube and for driving said holding means to hold or release the net rope, said drive means being housed in said outer tube and actuated by a detachable handle, said drive means comprising:

a first drive system including a first drive unit which is adapted to engage with said detachable handle through an opening formed in said outer tube and prevented from counter-rotating, and a first linkage connected between said first drive unit and said inner tube; and a second drive system including a second drive unit which is adapted to engage with said detachable handle through another opening formed in said outer tube and prevented from counter-rotating, and second linkage connected between said second drive unit and said rope holding means.

2. The adjusting device according to claim 1, wherein said first drive unit comprises a drive shaft rotatably arranged at a right angle with respect to the axis of said outer tube, said shaft being formed with a key hole at one end so as to engage with said handle, and further formed with screw in its external surface;

a drive gear formed with a hole in which an internal screw is formed and an external screw in its external surface, said drive gear being assembled on said drive shaft so as to be threadingly engaged therewith;

a friction clutch assembled on the other end of said drive shaft opposite said key hole so as to contact to said drive gear; and a drive nut formed with an external screw to threadingly engage with the external screw of said drive gear and a through hole formed with an internal screw to engage with said first linkage, said nut being rotatably arranged parallel to the axis of said outer tube.

3. The adjusting device according to claim 1, wherein said second drive unit comprises a drive shaft rotatably arranged at a right angle with respect to the axis of said outer tube, said shaft being formed with a key hole at one end so as to engage with said handle, said shaft being formed with screw in its external surface;

a drive gear formed with a hollow hole in which an internal screw is formed and an external screw in its external surface, said drive gear being assembled on said drive shaft so as to be threadingly engaged therewith;

a friction clutch assembled on the other end of said drive shaft opposite said key hole so as to contact to said drive gear; and a hollow gear formed with a polygonal cross section through hole in which said second linkage is engaged, and an external screw to engage with the external screw of said drive gear.

4. The adjusting device according to claim 1 or claim 2, wherein said first linkage comprises a thrust block secured to the bottom of said inner tube and formed with a screwed hole; and a first feed screw shaft formed with screw threads over its whole length, one end of said first feed screw shaft being threadingly fixed in the screwed hole of said thrust block and the other end being threadingly engaged with the internal screw of said drive gear of said first drive unit.

5. The adjusting device according to claim 1, wherein said second linkage comprises a polygonal cross section shaft, one end of said shaft being inserted through said polygonal cross section through hole;

a second feed screw shaft, the top end of said second feed screw shaft being connected to said rope holding means, and the bottom of said second feed screw shaft being connected to the other end of said polygonal cross section shaft through a coupling tube rotatably supported by said thrust block.

6. The adjusting device according to claim 1, wherein said rope holding means comprises a fixed bracket secured to the top end of said inner tube;

a fixed guide pulley fixed at the top end of said fixed bracket;

a nut formed with a screwed through hole in which said second feed screw is threadingly engaged;

a movable bracket rotatably secured to said nut;

a movable guide pulley secured to the top end of said movable bracket; and a rope stopper movably provided in a longitudinal slot formed in the top end of said inner tube.

7. The adjusting device according to claim 2 or 3, wherein said friction clutch comprises an annular disc plate secured to said drive shaft;

a ratchet rotatably and slidably assembled on said drive shaft, said ratchet being always engaged with a click urged towards said ratchet;

two pieces of liner which sandwich said ratchet therebetween; and a pressing annular plate rotatably and slidably assembled on said drive shaft.

8. The adjusting device according to claim 3 or 5, wherein said polygonal cross section through hole is a hexagonal cross section through hole.

9. The adjusting device according to claim 3 or 5, wherein said polygonal cross section shaft is a hexagonal cross section shaft.

10. The adjusting device according to claim 2, wherein said external screw of said drive gear and said external screw of said drive nut are right-hand crossed helical gears with helix angle of 45°, respectively.

11. The adjusting device according to claim 3, wherein said external screw of said drive gear and said external screw of said hollow gear are right-hand crossed helical gears with helix angle of 45°, respectively.

12. The adjusting device according to claim 6, wherein said stopper has a head formed in an arc shape, both side surfaces of said stopper being formed with substantially fan shaped recess widened upwardly, said fan shaped recess being engaged with said longitudinal slot, and said stopper being formed with a bottom groove so as to ride on the lower edge of said longitudinal slot.

13. An adjusting device according to claim 3 wherein said second linkage comprises a polygonal cross section shaft, one end of said shaft being inserted through said polygonal cross section through hole; and a second feed screw shaft, the top end of said second feed screw shaft being connected to said rope holding means, and the bottom of said second feed screw shaft being connected to the other end of said polygonal cross section shaft through a coupling tube rotatable supported by said thrust block.

14. An adjusting device according to claim 13 wherein said polygonal cross section through hole is a hexagonal cross section through hole.

15. An adjusting device according to claim 13 wherein said polygonal cross section shaft is a hexagonal cross section shaft.

16. An adjusting device according to claim 5 wherein said rope holding means comprises a fixed bracket secured to the top end of said inner tube;

a fixed guide pulley fixed at the top end of said fixed bracket;

a nut formed with a screwed through hole in which said second feed screw is threadingly engaged;

a movable bracket rotatable secured to said nut;

a movable guide pulley secured to the top end of said movable bracket; and a rope stopper movably provided in a longitudinal slot formed in the top end of said inner tube.

* * * * *